US005516317A

United States Patent [19]

Moody

[11] Patent Number: 5,516,317

[45] Date of Patent: May 14, 1996

[54] SYSTEM TO SINK AND FLOAT BUOYS

[76] Inventor: Kenneth D. Moody, 8662 Garonne Terrace 3d., Indianapolis, Ind. 46250

[21] Appl. No.: 489,137

[22] Filed: Jun. 9, 1995

[51] Int. Cl.[6] ..... B63B 22/06

[52] U.S. Cl. ..... 441/2; 441/6; 441/29; 441/30

[58] Field of Search ..... 441/1, 2, 6, 21, 441/68, 23, 28, 29, 30

[56] References Cited

U.S. PATENT DOCUMENTS

| | | | |
|---|---|---|---|
| 1,445,222 | 2/1923 | Linhardt | 441/28 |
| 2,790,186 | 4/1957 | Carapellotti | 441/21 |
| 2,847,962 | 8/1958 | Land | 441/30 |
| 3,878,576 | 4/1975 | Suyderhoud | 441/6 |
| 4,034,693 | 7/1977 | Challenger | 441/29 |
| 4,121,529 | 10/1978 | Smith et al. | 441/29 |
| 4,266,500 | 5/1981 | Jurca | 441/29 |

*Primary Examiner*—Stephen Avila

[57] ABSTRACT

Submarine (6) devices consisting of cavity to hold sand and an inflatable air bladder (10) are located beneath and connected to floating buoys (2). The weight of the sand when put inside the cavity is enough to sink buoy (2) until submarine (6) sits on the bottom of a lake or river. When bladders (10) are inflated by air supplied by an air compressor or a portable air tank, and distributed through a network of polyethylene tubing. They create enough buoyancy to offset the downward pull of the sand, thus allowing the buoys (2) to float back to the surface of the water.

5 Claims, 5 Drawing Sheets

SYSTEM TO SINK AND FLOAT BUOYS

BACKGROUND—FIELD OF INVENTION

This invention, which relates to buoys such as those used by water skiers, personal watercraft operators, swimmers, boaters, or fishermen, allows the user to protect and hide the buoys by submersing and raising them quickly and easily.

BACKGROUND—DISCUSSION OF PRIOR ART

For years water skiers have been installing buoys in conjunction with recreational and competitive water skiing. The buoys are usually about 30 cm in diameter, float at the surface, and are made of a bright vinyl material. These buoys are used to define the path of the skiers towboat and to provide "targets" that the skier must maneuver around to successfully complete the course. Most often, these buoys are configured in a "slalom" course, sometimes as a "trick" course, and sometimes as a guide course that positions the boat and the skier for jumping. In recent years, personal watercrafts have gained popularity and riders are using a "slalom" course for this activity as well. The basic difference between the above mentioned courses is the number of buoys and their proximity to each other in the water.

Presently, there are two basic methods of holding these buoys in place, one is a suspended cable system and, the other is an anchor or stake on the bottom that holds each buoy in place. The suspended cable system, originally made by Accufloat, has been on the market for twenty years. A main cable runs the length of the slalom course and is held tightly in place with two large anchors. Along this length of cable are cross-arms made of polyvinylchloride pipe connected perpendicular to the main cable. At these connections, the main cable splits into a "Y" shape on each side of the cross-arm, therefore connecting to it at two locations approximately 1.8 meters apart. When tension is applied to the main cable by pulling the anchors apart, the pipe sections align perpendicular to it. The pipe sections are suspended about five feet below the surface by ropes connected to the buoys, thus, the cross-arms and buoys hold each other in place.

Both the suspended cable system and the anchored system work quite well. The problem is with the buoys themselves. When these courses are not being used by the people who installed them, they are still floating on the surface. They are exposed to damage from other boaters, vandals, winter freezing, and ultraviolet sunlight. On crowded waterways, they can also become boating hazards at peak boating times. A slalom course can also become a point of contention between skiers, boaters, and fishermen who all feel that they have a right to use that portion of the lake or river. Many states and counties have enforced strict rules requiring individuals to remove these buoy systems when not in use or during certain hours.

Some skiers have addressed the problem by taking the buoys off of the course after each use and letting the remaining equipment sink to the bottom. This is very time consuming, uses a lot of energy, which could have been used for skiing and can be dangerous to those swimming around in boating areas.

Others have attempted pulley type systems with cables that connect to the buoys and pipes. When tension is applied to the cables, it pulls the buoys under. Others have attempted pulling the main cable so tight that it pulls the buoys under. Both of these systems require many large anchors and need to be located close to shore. They are difficult to install and maintain, and therefore have seen very little success.

In recent years, manufacturers have addressed this problem by offering "portable" suspended cable systems. These are essentially a collapsible, or folding version of the original Accufloat system. These systems are carried in the user's boat to the ski site where the anchors, cable, cross-arms, and buoys are assembled and launched into the water and then tightened. Because of their lighter construction, these courses so not provide the accuracy of the other systems mentioned. However, their biggest drawback is the amount of time required to install and retrieve them. A survey of several hundred users of these systems revealed that the average set up and retrieval time is about one hour. Skiers would much rather spend this time skiing. The other major drawback to these systems is the amount of space they require to carry and store in a typical ski boat. Ski boats tend to have little storage space to start with. In order to use a boat for other purposes, the system may have to be unloaded and stored in yet another location. However, because of the strong market demand for a solution to the buoy problem, there are now four manufacturers of these "portable systems" in spite of their drawbacks.

OBJECTS AND ADVANTAGES

Accordingly, several objects and advantages of my invention are:

1. to protect buoys from damage by other boaters
2. to protect buoys from damage by winter freezing
3. to protect the color of buoys from fading in the ultraviolet sunlight
4. to remove the safety hazard of buoys on crowded waterways
5. to allow skiers, boaters, and fisherman to use the same portion of a waterway for their own respective purposes.
6. to provide a system considerably easier to use than current methods
7. to provide a system considerably quicker to use than current methods
8. to provide a system that does not take up storage space in the boat
9. to provide a system that is safer to use than some current methods because its' operation does not require swimming Still further objects and advantages will become apparent from a consideration of the ensuing description and drawings.

DESCRIPTION OF DRAWINGS

In the drawings, closely related figures have the same number but different alphabetic suffixes. Most figures show some components that are not a part of the invention but are necessary to show for clarity of a particular embodiment of the invention.

DESCRIPTION OF INVENTION FIGS. 1–4

Figure 1B:
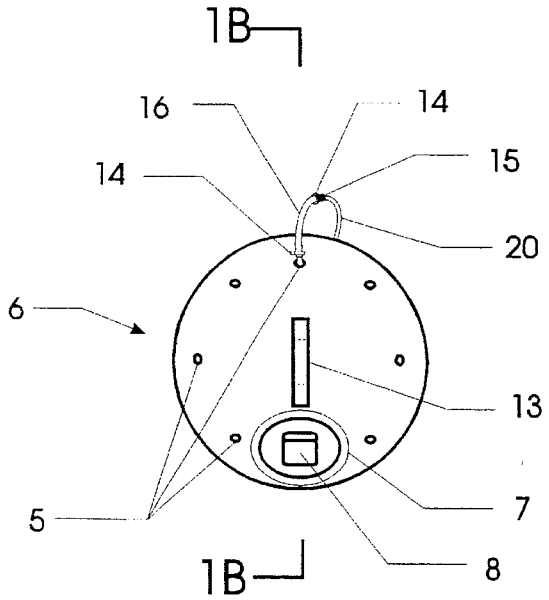
FIG. 1B—is a plan view of the Submarine devise showing the arrangement of holes.
Figure 1A:
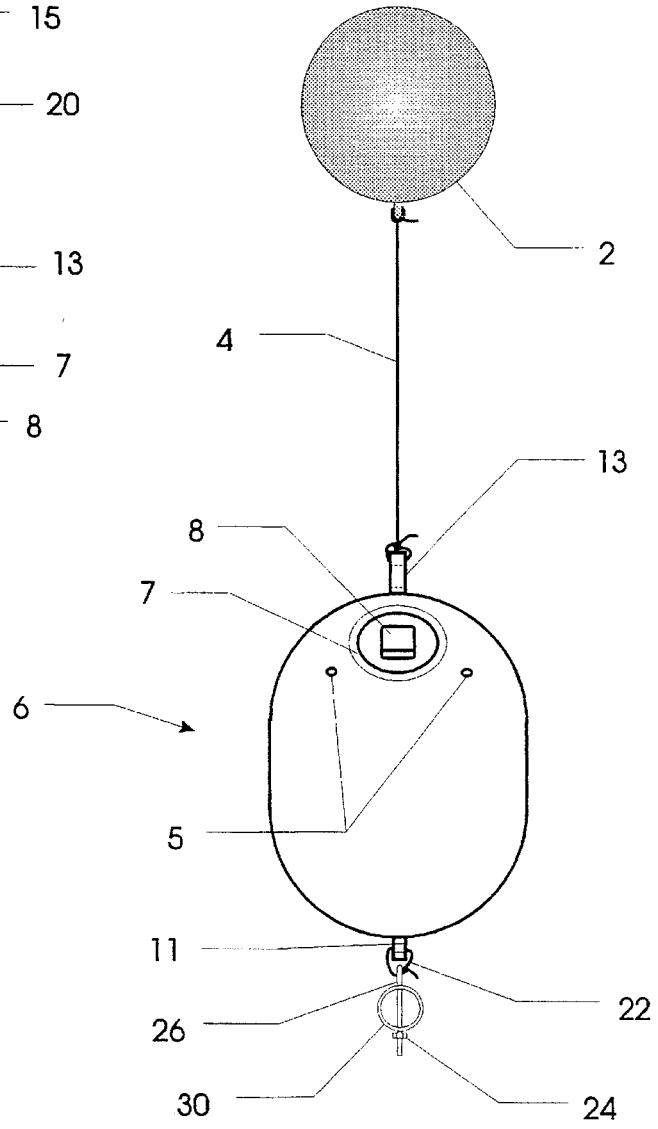
FIG. 1A—is an elevation showing a submarine device which is used in all embodiments of the invention.
Figure 1C:
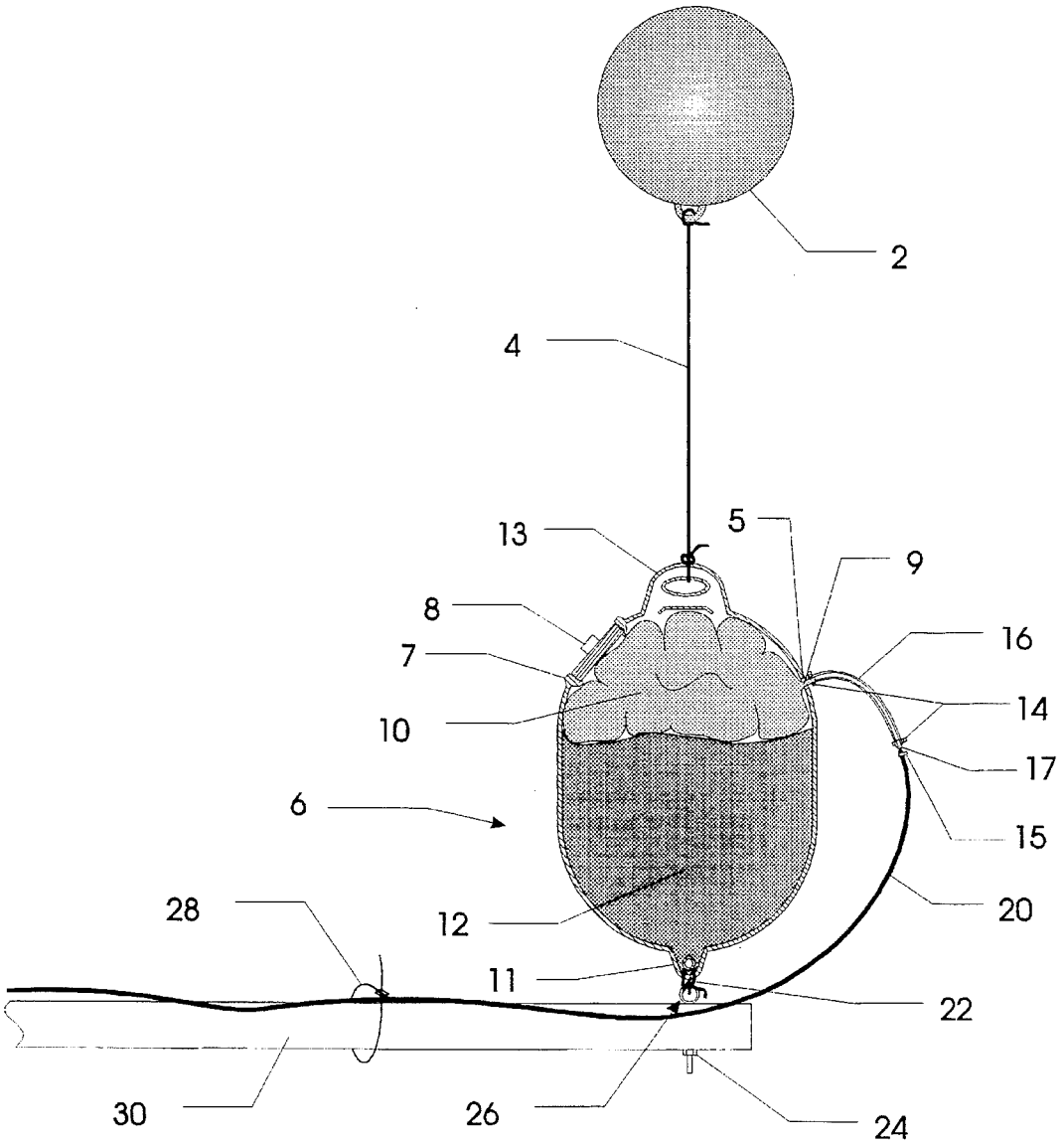
FIG. 1C—is a section of the submarine device taken along line 1B—1B of FIG. 1B showing interior and exterior components.

FIG. 1A (elevation), FIG. 1B (plan), and FIG. 1C (section) show a typical embodiment of a submarine 6.

A submarine 6 is a rotation molded polyethylene device. The installer of this device fills the bottom portion with sand 12 to a specified weight. A plastic threaded plug 8 is inserted into a threaded opening 7 of submarine 6. The opening 7 is to allow the installer to add the sand and adjust the sand level if necessary. The top portion of submarine 6 contains a rubber air bladder 10. Air bladder 10 has a fill tube 9 which is inserted through one of seven holes 9 in submarine 6 and connected to a vinyl tube 16 with an interlocking tooth plastic hose clamp 14. Vinyl tube 16 is connected to a barbed hose connector 17 with another hose clamp 14. The hose connector 17 is connected a polyethylene air tube 20 with a small plastic hose clamp 15. Air tube 20 is connected to a polyvinylchloride pipe cross-arm 30 with a nylon cable tie 28. When air is filled through the tubing and into the bladders 10, they will expand, pushing water out of the top portion of the submarine. This will create buoyancy that will offset the downward pull of the sand and allow the buoy 2 and the entire buoy system to rise until the buoys reach the surface. A buoy rope 4 is tied to a handle 13 of submarine 6 and to a buoy 2. A hook 11 on the bottom of submarine 6 is connected to an eyebolt 26 with a nylon rope 22. Eyebolt 26 is attached to cross-arm 30 with a nut 24.

Figure 2A:
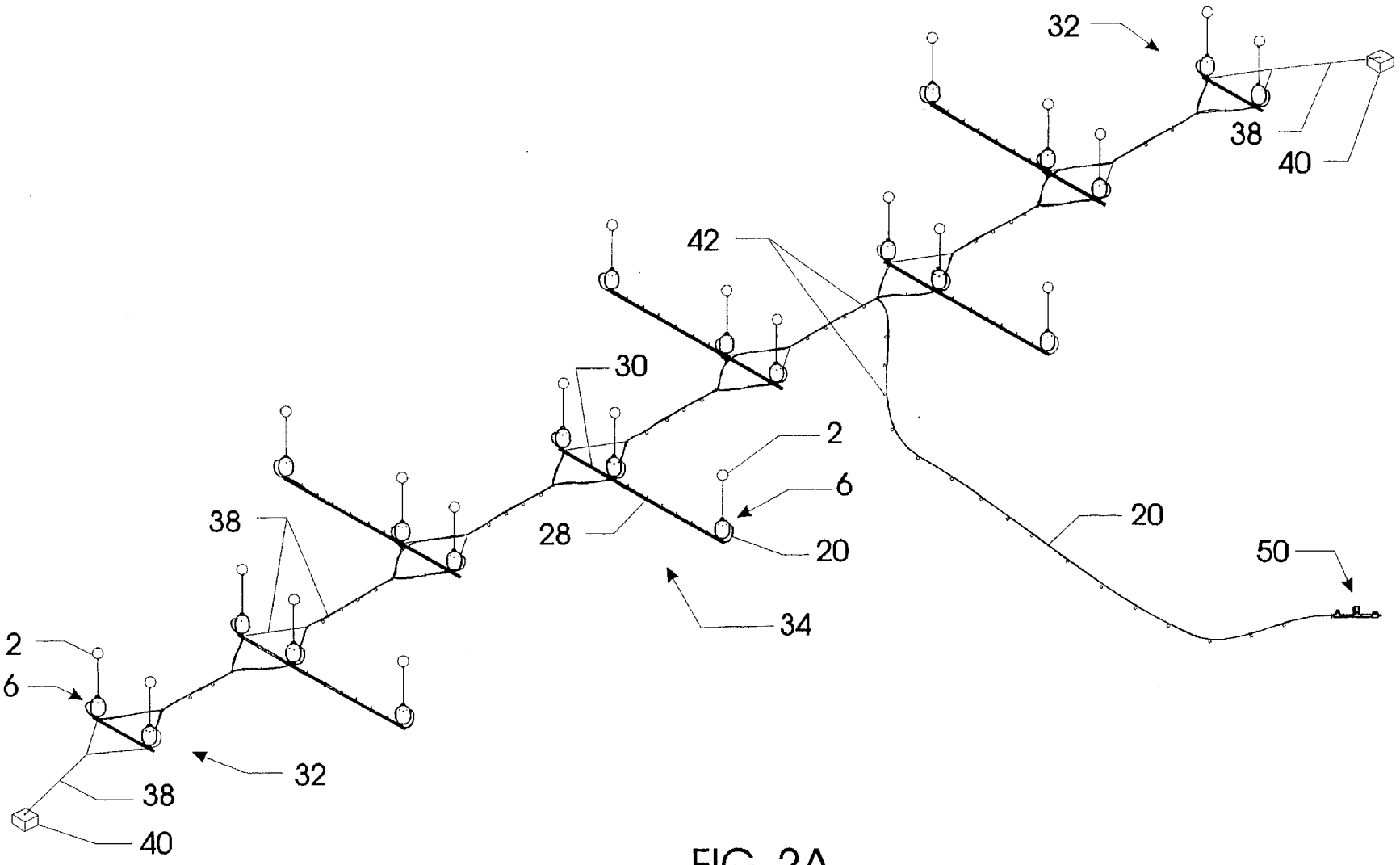
FIG. 2A—is an isometric showing the submarines attached to a standard suspended buoy system and networked together with air lines.

FIG. 2A (isometric) shows an embodiment of the system to sink and float buoys as used on a typical suspended buoy system (not part of this invention). This drawing shows just one of many buoy configurations used for swimming, boating, skiing, etc. One of the middle sections 34 (they are all similar) is shown in more detail in FIG. 2B. One of the end sections 32 (they are both similar) is shown in more detail in FIG. 2C. Each end section 32 and middle section 34 are held together by a steel cable 38 (or ropes). The entire suspended buoy system is held in place with a large concrete or steel anchor 40 connected to each end section 32 with another cable 38 (or rope). A submarine 6 is located below each buoy 2. The air tube 20 of each submarine 6 is connected to the cross-arm 30 with cable ties 28 at specified intervals. Air tubes 20 also connect to steel cable 38 (or rope) at specified intervals. Where the air tubes 20 connect to the cable 38 or lay directly on the bottom of a lake or river, a half brick 42 is connected to it with cable ties 28 at a specified intervals. A control valve assembly 50 is connected to the end of a section of air tube 20. Control valve assembly 50 is shown in more detail in FIG. 4.

Figure 2B:
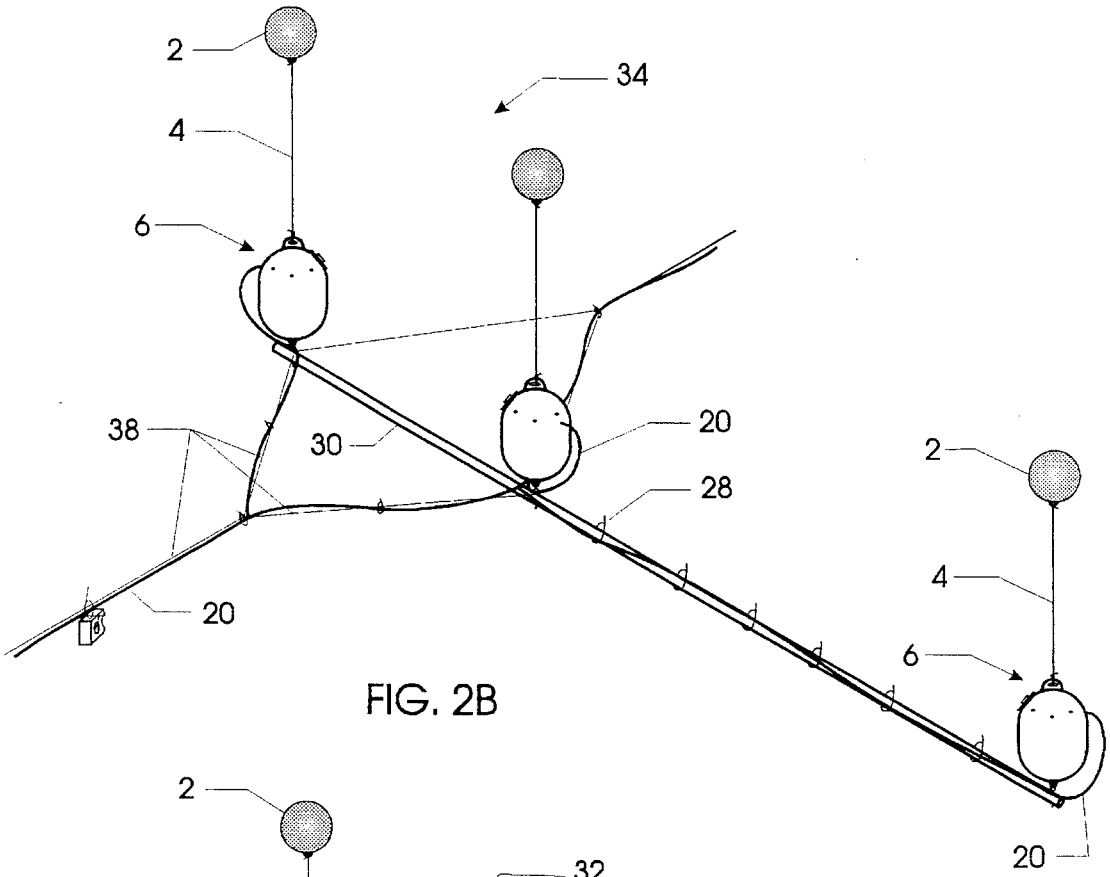
FIG. 2B—is an isometric showing a middle section of the suspended buoy system in greater detail.

FIG. 2B (isometric) shows one of several typical middle sections 34 of a typical suspended buoy system in greater detail.

Figure 2C:
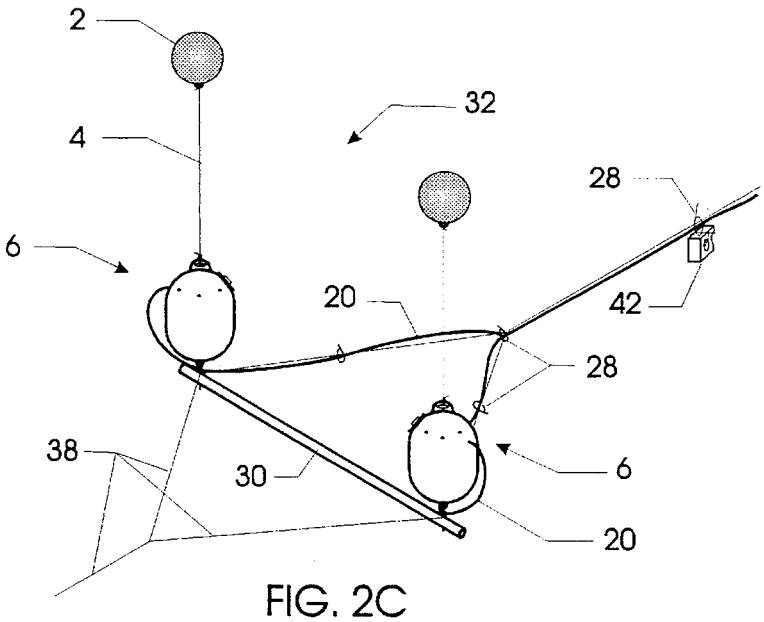
FIG. 2C—is an isometric showing an end section of the suspended buoy system in greater detail.

FIG. 2C (isometric) shows one of two typical end sections 32 of a typical suspended buoy system in greater detail.

Figure 3:
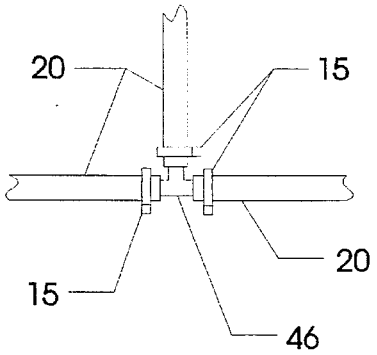
FIG. 3—is partial detail of air tube connections

FIG. 3 is a partial detail of the air tube 20 connections of the system shown in FIGS. 2A, 2B, and 2C. Air tubes 20 connect to a barbed tee connector 46 and are fastened with small plastic hose clamps 15.

Figure 4:
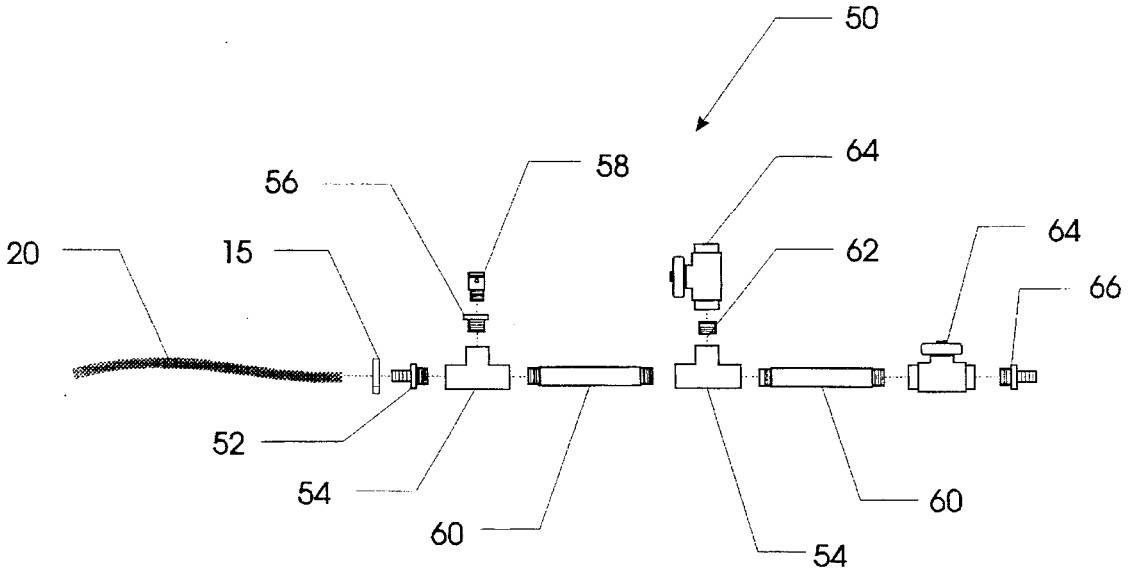
FIG. 4—is an expoded elevation showing a control valve assembly.

FIG. 4—is an elevation showing a control valve assembly. A barb to thread adapter 52 is connected to air tube 20 and secured with a small plastic hose clamp 15. Adapter 52 connects to threaded tee 54 which connects to threaded bushing 56 which connects to pressure relief valve 58. Pipe nipple 60 connects to tee 54 and to another tee 54. A nipple 62 connects this tee 54 to a ball valve 64. Another pipe nipple 60 connects this last tee 54 to another ball valve 64 which connects to a small barb to thread adapter 66. This control valve assembly 50 allows the user to fill the system with air to the necessary pressure. If more pressure is added, the pressure relief valve 58 will open to protect the system. A second ball valve 64 will allow the user to exhaust the air without having to disconnect the air supply devise from adapter 66.

OPERATION—FIG. 1,2,3,4

Before operating this invention, assembly and installation of the components is required. Because of the number of components and the unique obstacles encountered when installing this invention in a lake or river, There is a prescribed sequence of assembly and installation.

First, the submarines 6 will be assembled by filling the bottom with sand to a prescribed weight level and then inserting the threaded plug 8 into the threaded opening 7. Next, the air tubes 20 and control valve assembly 50 will be attached to the cables 38 and polyvinylchloride cross-arms 30 of the suspended buoy system. Finally, the submarines will be attached to cross-arms 30, and the buoys 2 will be attached to the submarines 6.

The actual operation of the invention is very simple. When the submarines 6 have sunk to the bottom, the buoys 2 are less than 2 meters above the bottom and in most cases, far below the surface where they are protected from other boaters who may accidentally, or intentionally run over them. They are also protected from ice that may form on the surface and from ultraviolet sunlight that can cause fading of the buoys' color. Most other boaters will not even know that a buoy system is in the water.

To raise the buoys 2, the operator simply fills the system at the control valve 50 with compressed air until all of the buoys have risen to the surface. The pressure relief valve 58 will open to protect the system if it is full of air and the operator has not shut off the air supply. As the air bladders 10 inside of the submarines 6 inflate, they push water out through the holes 5, thus creating enough buoyancy to offset the weight of the sand 12 and allow the buoys 2 to rise to the surface. The air may be supplied by a 12 v air compressor, a compressed air tank, or a high pressure tank (such as a scuba tank) carried in the operators boat. For some installations, the air tube 20 used as a feed line can be run to a location on shore (such as a persons' dock) and fed with a 110 v compressor or compressor and tank combination.

To lower the buoys, the operator simply opens the ball valve 64. Water will enter the submarine 6 through the holes 5, push on the bladders 10 and force the air out through the tubing 20. The inflation time ranges from two to ten minutes (for a water ski slalom course with twenty two buoys) depending on the depth of the water, the length of the feed-line and the speed of the inflation device. The time to deflate the system and lower the buoys is about two to five minutes depending on the length of the feed-line. Inflation and deflation times for other buoy systems with fewer buoys would be even less.

In the unlikely event of an air leak in the system, the buoys would sink back to the bottom where they are protected. Even if there is a leak and water has entered the system, some of the buoys will probably still rise. If not, the system can be resurfaced manually and the air leak repaired and the water blown out with air pressure.

CONCLUSION, RAMIFICATIONS, AND SCOPE OF INVENTION

Thus the reader will see that the system to sink and float buoys has many advantages over the over methods that people have been using and over the portable courses that are currently on the market. The benefits of this invention are summarized below:

1. It protects the buoys from other boaters on the lake or river. Considerable damage can occur if a motorboat driver accidentally or intentionally runs over any buoys.
2. It protects the buoys from damage caused by winter freezing. The user can simply leave the buoys on the bottom during the winter.
3. It protects the buoys from fading in color from exposure to ultraviolet sunlight.
4. It will remove the potential hazard on the water when a lake or river is being used by a large number a boaters.
5. It allows skiers, boaters, and fisherman to more easily enjoy the use of lakes and rivers.
6. This invention is very easy to operate. In fact, it requires little more than flipping a switch and opening a valve. Other methods may require allot of swimming to remove or reattach the buoys.
7. This invention is much quicker to operate than other methods. The portable systems can easily take over one hour to install and remove. Swimming around to take the buoys off and put them back on can take about an hour also.
8. Another advantage over the portable systems is that this system stays in the water. The portable systems need to be loaded into a boat and practically fill it with buoys, anchors, cable, and cross-arm sections. This would make it difficult to use the boat for recreational purposes. To use the boat for other purposes, this equipment would have to be unloaded and stored in another location.
9. This invention is designed to sink if a failure in the air distribution system should occur, thereby pulling the buoys under water where they are protected from damage.
10. Last but not least, this invention offers a safety advantage in that it does not require swimming for daily operation. Swimming around to install buoys in non-designated swim areas could be very dangerous if other motorboats are being operated in the area.

While my above description contains many specificities, these should not be construed as limitations on the scope of the invention, but rather as an exemplification of one preferred embodiment thereof. Many other variations are possible. For example, the system may use other shapes, sizes, or materials of the components, it may have a different number of submarines 6 or they may be located in different configurations. In these cases, the length and configuration of the air distribution system would change as well. Many different types of buoys, such as ski, swim, marker buoys, etc. could be sunk and floated with this system.

Other types of configurations or fastening devices may be used, etc. It may be modified slightly for use with an anchored or staked buoy system whereby the air tubes 20 would lay on the bottom of the lake or river instead of being attached to the cable 38 and cross-arms 30 of a suspended system. In this application, the submarines 6 would be attached to the buoy rope 4 about eight feet above the bottom when they are in the "up" position. When they sink, they would pull the buoys about eight feet below the surface. Accordingly, the scope of this invention should be determined not by the embodiments illustrated, but by the appended claims and their legal equivalents.

I claim:

1. A water sport course having a plurality of guide buoys controlled by a system which alternately sinks the buoys below the surface and raises the buoys to the water surface, comprising:

the control system which includes a submarine for each buoy;

each said submarine which includes a housing containing an inflatable bladder expandable and contractible within a water chamber, water vent holes, and ballast weight;

each said submarine being connected to an associated buoy by a tether line;

an air distribution system which includes a network of tubing to supply and remove air from the bladders of each submarine;

wherein the supplied to and from the bladders is controlled from a single point; and wherein supplying air to the bladders acts to inflate the bladders thereby expelling water from the submarines and causing the buoys to rise to the surface and removing air from the bladders acts to deflate the bladders thereby allowing water to enter the submarines causing the buoys to sink below the surface.

2. The water sport course of claim 1 wherein the course is a water ski slalom course.

3. The water sport course of claim 1 wherein the course is a water ski jump course.

4. The water sport course of claim 1 wherein the course is a water sport system suitable for use with personal watercraft.

5. A control system which alternately sinks the buoys below the surface and raises the buoys to the water surface engagable with a water sports apparatus in which this system includes at least one buoy, comprising:

a submarine for each buoy;

each said submarine which includes a housing containing an inflatable bladder expandable and contractible within a water chamber, water vent holes, and ballast weight;

each said submarine being connected to an associated buoy by a tether line;

an air distribution system which includes a network of tubing to supply and remove air from the bladders of each submarine;

wherein the supplied to and from the bladders is controlled from a single point; and wherein supplying air to the bladders acts to inflate the bladders thereby expelling water from the submarines and causing the buoys to rise to the surface and removing air from the bladders acts to deflate the bladders thereby allowing water to enter the submarines causing the buoys to sink below the surface.

* * * * *